US008726824B2

(12) United States Patent
Jarke

(10) Patent No.: US 8,726,824 B2
(45) Date of Patent: May 20, 2014

(54) SAILING VESSEL CONTROL DEVICE AND SYSTEM

(76) Inventor: Karsten Jarke, North Bondi (AU)

( * ) Notice: Subject to any disclaimer, the term of this patent is extended or adjusted under 35 U.S.C. 154(b) by 114 days.

(21) Appl. No.: 13/260,417

(22) PCT Filed: Mar. 25, 2010

(86) PCT No.: PCT/AU2010/000345
§ 371 (c)(1),
(2), (4) Date: Sep. 26, 2011

(87) PCT Pub. No.: WO2010/111731
PCT Pub. Date: Oct. 7, 2010

(65) Prior Publication Data

US 2012/0031319 A1 Feb. 9, 2012

(30) Foreign Application Priority Data

Mar. 31, 2009 (AU) ..... 2009901381

(51) Int. Cl.
*B63H 9/04* (2006.01)

(52) U.S. Cl.
USPC ..... 114/102.1; 114/102.2; 114/218

(58) Field of Classification Search
USPC ..... 114/102.1, 102.2, 102.16, 102.21, 218
See application file for complete search history.

(56) References Cited

U.S. PATENT DOCUMENTS

| | | | | |
|---|---|---|---|---|
| 4,022,144 | A | | 5/1977 | Gitchel |
| 4,671,201 | A | | 6/1987 | Yokoyama |
| 4,886,007 | A | | 12/1989 | Wheeler |
| 5,211,378 | A | | 5/1993 | Mackinnon, Jr. |
| 5,271,351 | A | * | 12/1993 | Horiuchi et al. ..... 114/106 |
| 5,467,726 | A | * | 11/1995 | Hutchins ..... 114/218 |
| 6,050,209 | A | * | 4/2000 | Vincent et al. ..... 114/98 |
| 6,308,649 | B1 | | 10/2001 | Gedeon |
| 6,718,898 | B1 | | 4/2004 | Anderson |

FOREIGN PATENT DOCUMENTS

| | | |
|---|---|---|
| EP | 0823372 | 2/1998 |
| FR | 2682661 | 4/1993 |
| FR | 2864517 | 7/2005 |
| WO | 98/24687 | 6/1998 |

* cited by examiner

*Primary Examiner* — Stephen Avila
(74) *Attorney, Agent, or Firm* — Mayback & Hoffman, P.A.; Gregory L. Mayback

(57) ABSTRACT

The present disclosure relates to a sailing vessel control device having a cleat means, a resistance means, a line having a first end located through the cleat means and a second end attached to the resistance means, and a sensor adapted to detect the extent to which the line is pulled through the cleat means and to output a line signal corresponding to the position of the line for use in controlling the sailing vessel. The line signal which can be used to control the sail(s) of the vessel can be generated in a traditional, manual manner (i.e. by pulling on the line). The present disclosure further relates to a sailing vessel control system having one or more of the sailing vessel control devices, one or more sail actuators, and a control unit.

14 Claims, 3 Drawing Sheets

SAILING VESSEL CONTROL DEVICE AND SYSTEM

CROSS-REFERENCE TO RELATED APPLICATIONS

This application claims the priority, under 35 U.S.C. §119, 120, 363, and 371, of Australian Patent Application No. 2009/901381, filed Mar. 31, 2009, and International Application No. PCT/AU2010/000345 filed Mar. 25, 2010, which designated the United States, these prior applications are herewith incorporated by reference in their entirety.

STATEMENT REGARDING FEDERALLY SPONSORED RESEARCH OR DEVELOPMENT n/a

FIELD OF THE INVENTION

The present invention relates to control of vessels and in particular to a sailing vessel control device and system.

The invention has been developed primarily for use with sailing vessels and will be described hereinafter with reference to this application. However, it will be appreciated that the invention is not limited to this particular field of use. It should also be noted that the invention is applicable to a wide variety of sailing vessels including dinghy's, catamarans and yachts.

BACKGROUND OF THE INVENTION

To control a sailing boat, its sails need to be moved or otherwise adjusted using the vessel's rope lines, collectively called the running rigging. For example, the main sheet is used to move the boom of the main sail while the jib sheets are used to adjust the effective angle of the jib sail. A variety of other lines are often used to control other aspects of the position and shape of the sail(s).

In most sailing boats, lines are adjusted manually although autonomous and semi-autonomous sailing boats are also known. For example, some yachts have electric or hydraulic winches to wind in or let out lines that can be controlled at a user interface (e.g. by buttons).

The sport of sailing is enjoyed by many and at least part of this enjoyment is generally derived from manually participating in controlling the vessel. Technology is such that sailing vessels can control themselves autonomously but such systems would detract from the sailing experience in a recreational setting.

One well known problem in sailing is when vessels heel at too great an angle. This can happen due to a gust of wind or simply due to user error. If a vessel heels at too great an angle it may capsize and this could cause damage to the vessel or its contents. There are several known solutions to vessels overheeling and these include: hull design, a weighted keel and movement of the crew to the high side of the vessel.

The present invention seeks to provide a sailing vessel control device and system which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE INVENTION

According to a first aspect of the present invention, a sailing vessel control device is provided, comprising:

- a cleat means,
- a resistance means,
- a line having a first end located through the cleat means and a second end attached to the resistance means, and
- a sensor adapted to detect the extent to which the line is pulled through the cleat means and to output a line signal corresponding to the position of the line for use in controlling the sailing vessel.

Advantageously, a control signal (i.e. the line signal) which can be used to control the sail(s) of the vessel can be generated in a traditional, manual manner (i.e. by pulling on the line). This allows emulation of traditional sailing rigging to control a sailing vessel electronically and thus technological innovation can be incorporated into the sailing experience without detracting from the sailor's enjoyment.

Advantageously, the line signal may serve as an input into an algorithm executed by a processor which can then generate an output signal to control an electric winch or other actuator to change the sail angle, position or shape. The algorithm may additionally receive other inputs (e.g. from sensors) to augment or modify the output signal for the purposes of improving sailing effectiveness or safety, for example.

Preferably, the sailing vessel control device further comprises an actuator adapted to apply a feedback force to the line.

Advantageously, applying a feedback force to the line enhances the user's sailing experience by emulating traditional sailing to an even greater extent. If the feedback force is representative of the load on the sail(s) then this can assist the user in adjusting the sail(s) to obtain a desired sailing outcome.

Preferably, the actuator and sensor are provided by a servo motor.

Advantageously, by using a servo motor, the position of the line can be detected and a feedback force can be applied to the line by a single unit.

Preferably, the resistance means is a biasing means adapted to bias the line towards the biasing means.

Advantageously, this emulates more closely the feeling of pulling on a sail line (e.g. a main sheet or jib sheet).

Preferably, the biasing means is a gas spring. In another embodiment, the biasing means is a coil spring.

Preferably, the sailing vessel control device further comprises a pulley arrangement and wherein an intermediate portion of the line is threaded through the pulley arrangement to provide a mechanical advantage to a user pulling on the first end of the line in use.

According to a second aspect of the present invention, a sailing vessel control system is provided, comprising:

- one or more of the sailing vessel control devices according to the invention,
- one or more sail actuators, and
- a control unit adapted to receive and then process the one or more line signals and to send one or more actuator signals to the respective one or more sail actuators to cause the one or more sail actuators to move one or more corresponding sails.

Advantageously, the system allows a sailing vessel to be controlled electronically but in conjunction with a traditional user interface (i.e. one or more lines).

Advantageously, the force required to trim the sail is independent of the sail size. This allows users who are physically less strong (e.g. the elderly) to trim any sail size. Furthermore, the crew does not have to handle lines under high loads directly. This eliminates associated hazards (e.g. muscle strain).

Advantageously, the mounting position of the one or more sail actuators (e.g. winches) is more flexible. No physical access is required during normal operation since the actuator(s) are controlled electronically. The flexible actuator(s) position can be used to remove line clutter in the cockpit. Furthermore, in another embodiment, linear actuators could be installed within or on (i.e. the outside of) the mast or boom.

Preferably, the sailing vessel control system further comprises one or more vessel sensors and wherein the control unit is further adapted to receive and process information from the one or more sensors to modify the one or more actuator signals to improve sailing effectiveness, in use.

Advantageously, it is possible to automate sail trim or improve or optimize the trim of a sail that has only been trimmed manually. The control unit can send trim commands to the one or more sail actuators based on environmental or other variables detected by the one or more vessel sensors.

Advantageously, safety functions can be incorporated. For example, if one of the environmental variables or heel angle exceeds a certain limit then the sail(s) can be automatically eased or power to the winch can be cut.

Preferably, the one or more vessel sensors include one or more sensors from the following group of sensors: a wind speed sensor, a wind direction sensor, a heel sensor, a servo input, a rudder position sensor, a user input device and a GPS unit.

Preferably, the one or more actuators are adapted to apply a feedback force to the line that is substantially proportional to the resistance experienced by the one or more sail actuators in use.

Advantageously, the sailor is provided with an accurate feeling of the load on a given sail(s).

Preferably, the one or more vessel sensors comprise at least a wind direction sensor and a heel sensor and the control unit is adapted to identify the tack of the vessel in use based on the information received from these sensors and to send one or more actuator signals to at least one of the one or more sail actuators to move a jib sail based on the tack of the vessel in use.

Advantageously, the vessel is able to tack its jib sail autonomously. This can allow or make it easier for a single sailor to sail a large yacht. In one embodiment, this functionality is activated automatically as required when a sailor fails to tack a vessel appropriately.

Preferably, the one or more vessel sensors further comprise a rudder position sensor.

According to a third aspect of the present invention, a sailing vessel control system is provided, comprising:

one or more sail actuators adapted for moving one or more sails of a vessel, a processor adapted to control the one or more sail actuators, and one or more vessel heel sensors adapted to send heel signals to the processor, the processor being further adapted to receive and process the heel signals and to send one or more actuator signals to the one or more sail actuators to cause the sail actuators to ease the one or more sails if the heel angle of the vessel is excessive.

Advantageously, the system may allow a capsize scenario or excessive heel resulting in reduced sailing efficiency to be avoided.

Other aspects of the invention are also disclosed.

BRIEF DESCRIPTION OF THE DRAWINGS

Notwithstanding any other forms which may fall within the scope of the present invention, preferred embodiments of the invention will now be described, by way of example only, with reference to the accompanying drawings in which.

DETAILED DESCRIPTION OF SPECIFIC EMBODIMENTS

Figure 1:
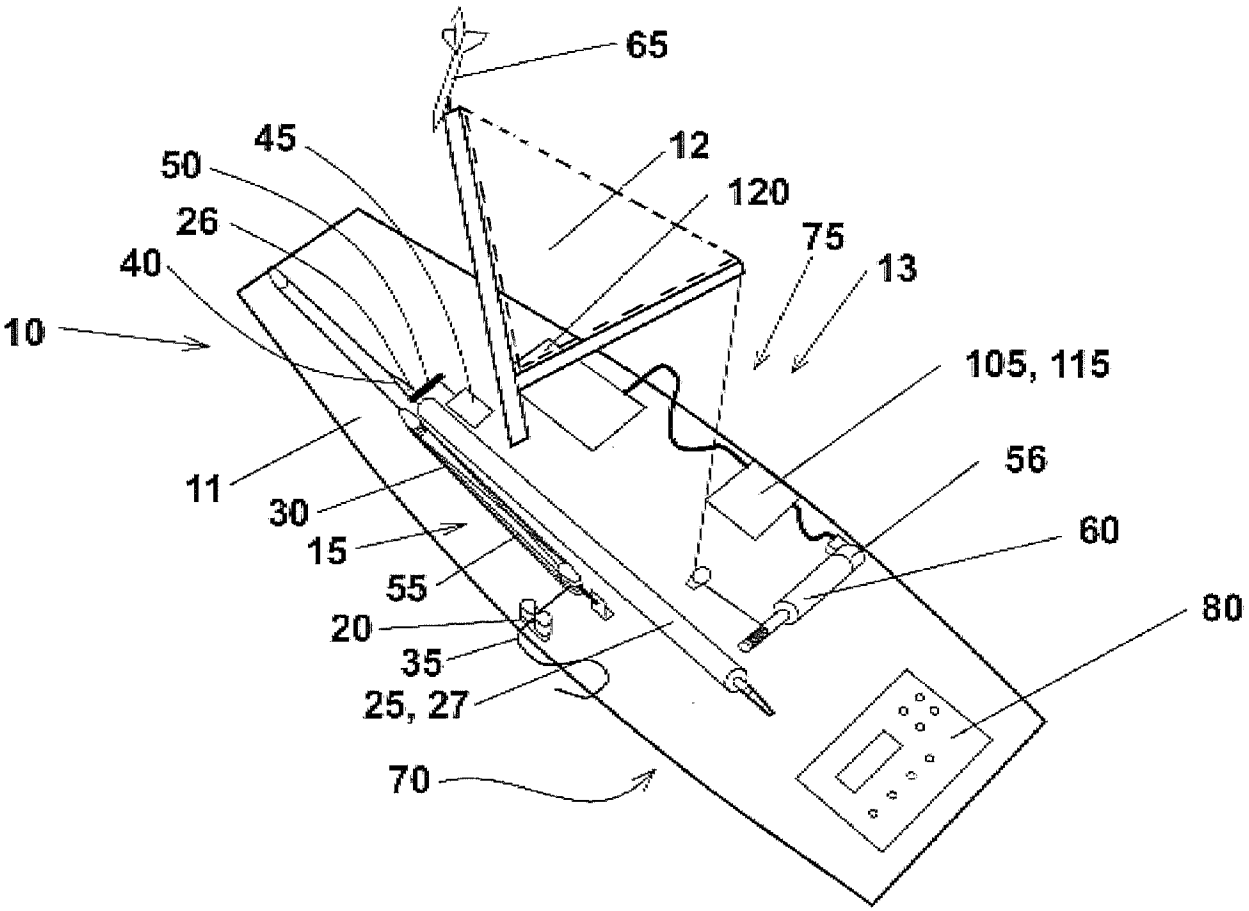
FIG. 1 is a perspective view of a model of a vessel incorporating a sailing vessel control system in accordance with a preferred embodiment of the present invention where the a vessel sail is shown in phantom lines.

It should be noted in the following description that like or the same reference numerals in different embodiments denote the same or similar features.

Referring to FIG. 1, it should be understood that although a model of a vessel incorporating a sailing vessel control system is shown, this is merely to illustrate the functionality of the proposed sailing vessel control device and system, and in a real-life, full-sized embodiment, all components would be adjusted/replaced by equivalent or similar components as required.

For the purposes of this description, the vessel model will be described as a full-sized sailing vessel and its components will be described as though they were those of a full-sized sailing vessel. Thus, the sailing vessel 10 comprises a hull 11, a sail 12 and a sailing vessel control system 13 which, in turn, comprises a single sailing vessel control device 15.

The sailing vessel control device 15 comprises a cleat means taking the form of a standard cleat 20, a resistance means taking the form of a gas spring 25. The gas spring 25 comprises a piston member (not shown), a piston extension 26 and a cylinder 27. The sailing vessel control device 15 further comprises a line 30 having a first end 35 located through the cleat 20 and a second end 40 attached to the piston extension 26. The gas spring 25 biases the line 30 towards the gas spring 25 in use.

The sailing vessel control device 15 further comprises a servo motor 45 having a control rod arrangement 50 connecting it to the piston extension 26 and being adapted to both:

(i) detect the extent to which the line 30 is pulled through the cleat 20 and to output a line signal corresponding to the position of the line 30; and (ii) to apply a feedback force to the line.

The sailing vessel control device 15 further comprises a pulley arrangement 55, wherein an intermediate portion of the line 30 is threaded through the pulley arrangement 55 to provide a mechanical advantage to a user pulling on the first end of the line 30 in use.

An optical encoder 56 interconnects and allows signals to be sent between the control unit 75 and the sail actuator 60.

The sailing vessel control device 15 provides at least the following advantages:

1. The line signal which is outputted by the servo motor 45 can be used to control the sail 12 of the vessel 10 and is generated in a traditional, manual manner (i.e. by pulling on the line 30). This allows emulation of traditional sailing rigging to control the vessel 10 electronically and thus technological innovation can be incorporated into the sailing experience without detracting from the sailor's enjoyment.

2. The line signal may serve as an input into an algorithm executed by a processor which can then generate an output signal to control an electric winch or other actuator to change the sail angle, position or shape. The algorithm may additionally receive other inputs (e.g. from sensors) to augment or modify the output signal for the purposes of improving sailing effectiveness or safety, for example.
3. Applying a feedback force to the line 30 enhances the user's sailing experience by emulating traditional sailing to a greater extent. In this embodiment, the feedback force is representative of the load on the sail 12 and this can assist the user in adjusting the sail(s) to obtain a desired sailing outcome.
4. The servo motor 45 allows the position of the line 30 to be detected and a feedback force to be applied to the line 30 by a single unit.

It should be noted that in a simpler embodiment, the servo motor 45 is replaced by a string potentiometer and no feedback force is provided.

The sailing vessel control system 13 also comprises a sail actuator 60, a wind vane 65, a heel sensor 70, a control unit 75 and a user interface 80. The control unit 75 is adapted to receive and then process the line signals and the data outputs from the wind vane 65, heel sensor 70 and user interface 80 and to create and send actuator signals to the sail actuator 60 to cause it to move the main sail 12. In one embodiment, the actuator signals may be modified by the control unit 75 based on the data output from the wind vane 65 (which measures wind speed and direction) and the heel sensor 70 to improve sailing effectiveness.

In another embodiment, a variety of other vessel sensors may be incorporated into/onto the vessel 10 and connected to the control unit 75. These vessel sensors may include a rudder position sensor and/or a GPS unit.

In this embodiment, the servo motor 45 is adapted to apply a feedback force to the line 30 (via the control rod arrangement 50) that is substantially proportional to the resistance experienced by the sail actuator 60 in use (i.e. the force of the wind against the sail 12). The sailing vessel control system 13 provides at least the following advantages:

1. It allows the sailing vessel 10 to be controlled electronically but in conjunction with a traditional user interface (i.e. one or more lines 30).
2. The force required to trim the sail 12 is independent of the size of the sail 12. This allows users who are physically less strong (e.g. the elderly) to trim any sail size. Furthermore, the crew does not have to handle lines 30 under high loads directly. This eliminates associated hazards (e.g. muscle strain).
3. The mounting position of the sail actuator 60 (e.g. a winch) is more flexible. No physical access is required during normal operation since the actuator 60 is controlled electronically. The flexible actuator position can be used to remove line clutter in the cockpit. Furthermore, in another embodiment, linear actuators could be installed in or on the mast or boom.
4. It is possible to automate the trim of the sail 12 or improve the trim of the sail 12 if it has only been manually trimmed. The control unit 75 can send trim commands to the sail actuator 60 based on environmental or other variables detected by the vessel sensors (e.g. the wind vane 65 & heel sensor 70).
5. Safety functions can be incorporated. For example, if one of the environmental variables or heel angle exceeds a certain limit, then the sail 12 can be automatically eased or power to the actuator (e.g. winch) can be cut.
6. The sailor can be provided with an accurate feeling of the load on a given sail by virtue of the feedback through the line 30.

In another embodiment, a vessel 10A further comprises a jib sail, a rudder position sensor, a jib sailing vessel control device 15A, a jib actuator 60A and a control unit 75A. The control unit 75A is adapted to identify the tack of the vessel 10A in use based on the information received from the rudder position sensor, the wind vane 65A and the heel sensor 70A to send actuator signals to the jib actuator 60A to move the jib sail based on the tack of the vessel 10A in use.

Advantageously, the vessel 10A is able to tack its jib sail autonomously. This can allow or make it easier for a single sailor to sail a large yacht. In one embodiment, this functionality is activated automatically as required when a sailor fails to tack the vessel 10A appropriately.

In yet another embodiment, a sailing vessel control system 13B comprises a vessel heel sensor 70B adapted to send heel signals to a processor, the processor being further adapted to receive and process the heel signals and to send actuator signals to a sail actuator 60B to cause the sail actuator 60B to ease a sail 12B if the heel angle of a vessel 10B is excessive.

Thus, if a programmed heel angle is exceeded, the sail actuator 60C automatically eases the main sail 12B to prevent loss of control over the vessel direction. Once the heel angle has recovered, the previous operating mode is entered.

Advantageously, the system 13B may allow a capsize scenario or excessive heel resulting in reduced sailing efficiency to be avoided. This safety feature is very useful for modern wide beam boats which become uncontrollable at relatively small heel angles or catamarans where preventing capsizing is particularly important.

Figure 2:
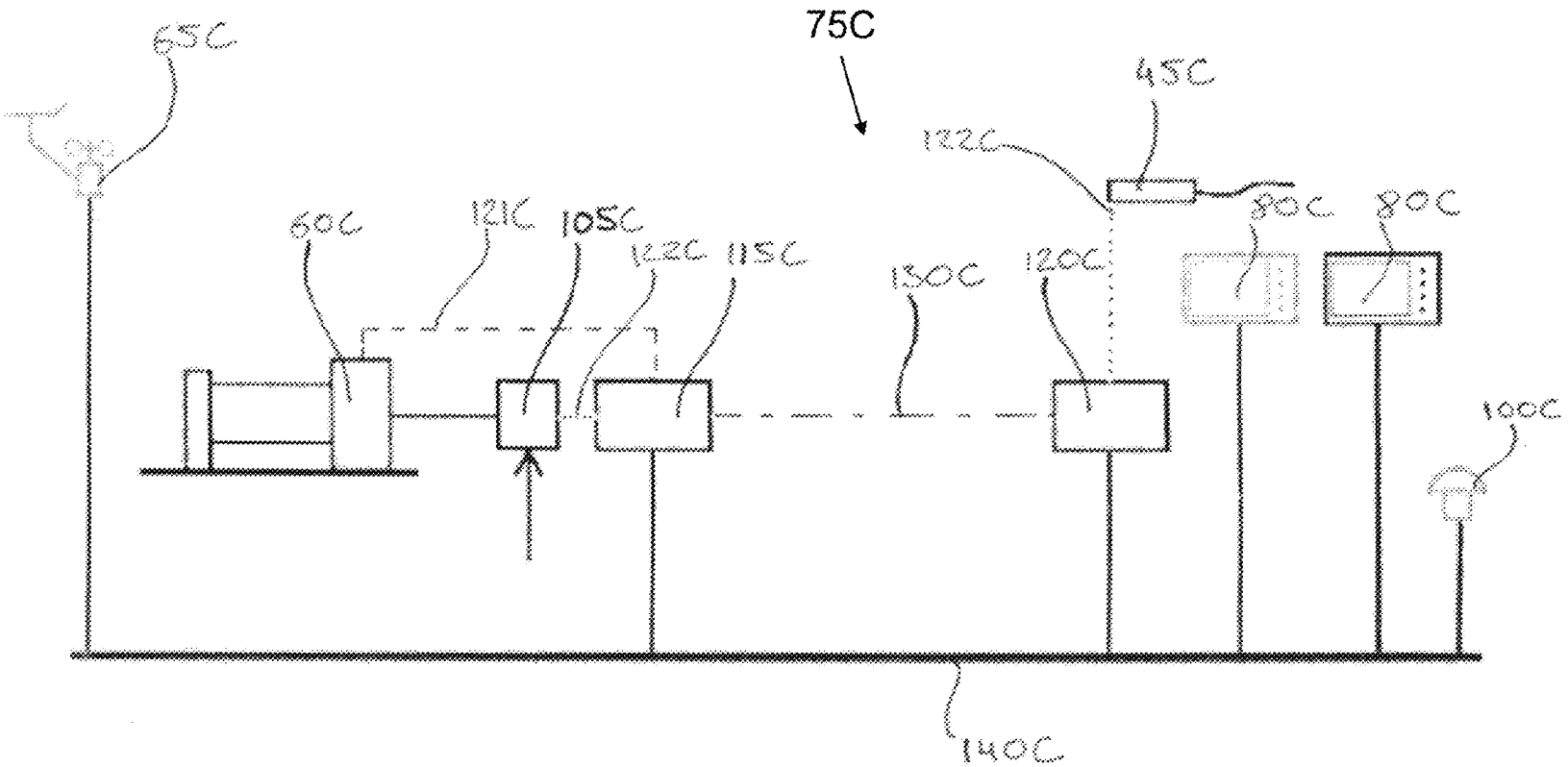
FIG. 2 is a schematic diagram of a sailing vessel control system in accordance with another preferred embodiment of the present invention.

Referring to FIG. 2, a sailing vessel control system 13C comprises a sail actuator 60C, a control unit 75C, a servo motor 45C, a user interface 80C, a wind vane 65C and a GPS antenna 100C. Specifically, the control unit 75C comprises an electric amplifier 105C as in this embodiment the sail actuator 60C is electrically powered, a motion controller 115C and a central controller 120C. In another embodiment, the sail actuator 60C is hydraulically powered and thus the control unit 75C comprises one or more hydraulic control valves instead of the electric amplifier 105C.

The motion controller 115C reads the position and force feedback (shown in FIG. 2 by line 121C) from the sail actuator 60C and sends this data to the central controller 120C. It also receives position or speed commands from the central controller 120C. The motion controller 115C also sends control commands to the electric amplifier 105 via an analog connection 122C or alternatively a PWM (Pulse Width Modulation) connection to reduce the position error or to achieve a desired sail actuator 60C speed.

The central controller 120C sends position or speed commands to the motion controller 115C. It also receives data inputs from the wind vane 65C (i.e. a wind speed and direction sensor), a heel sensor 70C, the servo motor 45C, a rudder position sensor and a joystick. The central controller 120C receives force data from the motion controller 115C. If force feedback is enabled, the central controller 120C sends force commands to the servo motor 45C. The central controller 120C further comprises computer readable memory in which a database of available sails, including the following information, is stored:

1. sail identification
2. maximum and minimum actuator positions
3. maximum sheet load
4. fine trim parameters
5. force feedback parameters In this case, the servo motor 45C is connected to a spring-loaded control line manually operated by the crew. The central controller 120C is adapted to measure the position (length) of the spring.

In another embodiment, the spring is replaced by a variable force actuator. The force actuator receives force commands from the central controller 120C and the central controller 120C measures the position (length) of the force actuator.

The sailing vessel control system 13C can be operated in a number of different modes, including:

Manual Mode:

In this mode, the speed of the movement of the sail actuator 60C is controlled by a joystick. That is, the central controller 120C sends speed commands to the motion controller 115C based on the joystick input. Other input devices may be used instead of the joystick, such as a mouse or keyboard.

In another embodiment, the crew can move the sail actuator 60C by pressing IN and OUT buttons on a user interface 80C.

Servo Mode:

In this mode, the central controller 120C sends position data to the motion controller 115C based on the position of the servo motor 45C. The relationship between the position of the servo motor 45C and the position of the sail actuator 60C can be linear or non-linear. A non-linear relationship allows implementation of electronic fine trim.

An example of electronic fine trim follows:

When sailing downwind, a small position change from the servo motor 45C leads to a large change of the winch position. When sailing upwind, this is reversed and a large position change from the servo motor 45C is required to trim the sail 12C. This allows for finer sail adjustments when sailing upwind.

It should also be noted that in one embodiment, the servo mode is entered by moving the servo motor 45C to the current sail actuator 60C position. This avoids jumps in the sail actuator 60C position.

Servo Mode with Force Feedback:

In this mode, the central controller 120C sends position data to the motion controller 115C based on the position of the servo motor 45C. The relationship between the position of the servo motor 45C and the position of the sail actuator 60C can be linear or non-linear. The central controller 120C sends force commands to the servo motor 45C based on force data received from motion controller 115C. The relationship between the force on the sheet and the force applied to the control line 30C can be linear or non-linear.

Automatic Mode:

In this mode, the central controller 120C sends position commands to the motion controller 115C based on the wind direction and speed. The control unit 75C trims the sail automatically without user input based on trim curves pre-programmed into the central controller 120C. In one embodiment, different trim curves are provided for different wind strength to account for stretch in the sails and sheets and different optimum sail trim angles.

Automatic Tack Function:

In this mode, the jib sail is self-tacking. The control unit 75C senses tack based on rudder angle, change of heel angle and change of wind direction. The control unit 75C also eases the jib sheet on the old tack and pulls the jib sheet on the new tack. Only one servo device 45C would be required to control either of the jib winches as the control unit 75C may be adapted to automatically activate the correct winch.

Heel Angle Monitoring:

In this mode, the control unit 75C monitors the heel angle. If the heel angle exceeds a certain programmed value the mainsheet is eased automatically. The mainsheet is then trimmed back to its previous position if the heel angle recovers.

Sheet Overload Protection:

The control unit 75C releases the sheet if the sheet load exceeds a certain maximum sheet load for the sail 12C stored in the database.

In this embodiment, a dedicated serial data connection 130C is provided and interconnects the central controller 120C and the motion controller 115C. The central controller 120C can also be connected to a NMEA 2000 network 140C or other equivalent or similar network to receive sensor data.

In one embodiment, by also connecting the winch controller to the NMEA 2000 network 140C, a second communication link between the winch controller and central controller can be created. This additional communication link can be used in fault situations as a back-up. Reduced functionality would be available even if the NMEA 2000 network 140C or the dedicated serial connection 130C is down and the user interface 80C has a fault.

Figure 3:
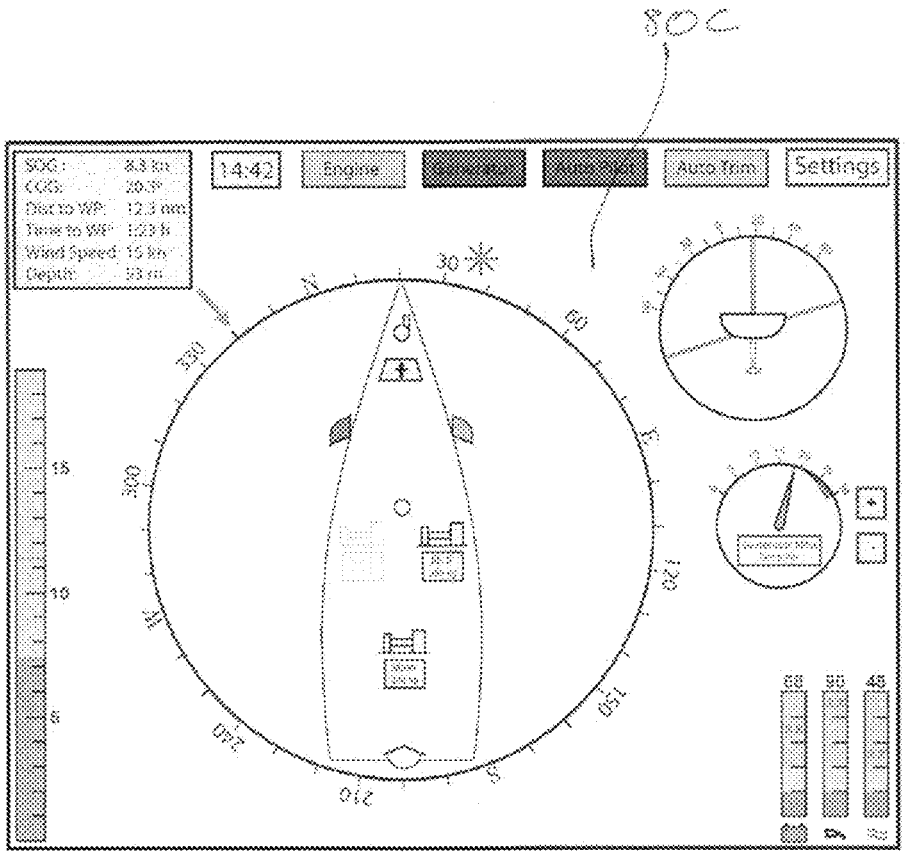
FIG. 3 is a schematic diagram of a user interface of the sailing vessel control system of FIG. 2.

Furthermore, by virtue of the NMEA 2000 network 140C it is possible for the user interface 80C to display functions other than the sail-by-wire functions discussed above. A fully integrated system allows operation of the sail actuators 60C, navigation lights, auto-pilots, engine and generator and could further display GPS information, wind information, tank and battery levels, engine temperature, engine RPM, boat speed and heel angle. The user interface 80C could also receive data from a navigation unit and display a moving map image. An example of such a user interface 80C is shown in FIG. 3.

While the invention has been described with reference to a number of preferred embodiments it should be appreciated that the invention can be embodied in many other forms.

For example, the sail actuator of any of the above embodiments may take the form of, inter alia, a winch or a linear actuator. The winch can be electrically or hydraulically powered and the linear actuator can be hydraulically or electrically powered. By use of a transducer, the actuator can provide position feedback to the control unit and the actuator can also provide force feedback to the line.

In one embodiment where the motion controller is a winch controller, the winch controller may monitor the actual position of the winch by analyzing signals from the position transducer mounted to the winch. The winch controller receives position commands from the central controller, compares the command position to the actual position and supplies power to the winch motor to reduce the position error. For smooth winch movement, acceleration and speed curves or maximum accelerations and speeds can be programmed. The winch controller also sends status data to the central controller.

In another embodiment, the central controller also monitors the status of various sensors and buttons and communicates with a user interface. The central controller may also be adapted to detect fault situations based on sensor, input and/or feedback data.

In yet another embodiment, the user interface displays various vessel information and allows a user to operate the sail actuator (e.g. winch) via buttons and important parameters (e.g. sail parameters) to be changed.

In another embodiment, the load on the sail actuator is continuously monitored. On electric winches the current consumed by the winch motor is substantially proportional to the load on the winch. The sailing vessel control system can be configured such that once the load exceeds a programmable limit, the winch automatically cuts power to the motor and eases the sheet. The winch is re-started via user input.

In yet another embodiment, the user interface includes a panic button which when pressed immediately stops the sail actuator(s).

In another embodiment, the actuator of the sailing vessel control device is also the resistance means. For example, where the actuator is a servo motor, the servo motor may be adapted to provide a tension force in the line and thus no separate resistance means is required.

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose.

It is apparent from the above, that the arrangements described are applicable to the manufacture of sailing vessels amongst other industries.

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

The claims defining the invention are as follows:

1. A sailing vessel control device, comprising:
a cleat means,
a resistance means,
a line having a first end located through the cleat means and a second end attached to the resistance means, and
a sensor operable to:
detect manual input, the manual input comprising an extent to which the line is pulled through the cleat means, and
output a line signal generated from the detected manual input and corresponding to a position of the line, the output line signal for use by a separate device to control the sailing vessel.

2. A sailing vessel control device according to claim 1, further comprising an actuator operable to apply a feedback force to the line.

3. A sailing vessel control device according to claim 2, wherein the actuator and the sensor are provided by a servo motor.

4. A sailing vessel control device according to claim 1, wherein the resistance means is a biasing means operable to bias the line towards the biasing means.

5. A sailing vessel control device according to claim 4, wherein the biasing means is a gas spring.

6. A sailing vessel control device according to claim 1, further comprising a pulley arrangement and wherein an intermediate portion of the line is threaded through the pulley arrangement to provide a mechanical advantage to a user pulling on the first end of the line in use.

7. A sailing vessel control system, comprising:
one or more of the sailing vessel control devices of claim 1 each outputting the line signal,
one or more sail actuators, and
the separate device, which comprises:
a control unit operable to receive and then process the line signal of each sailing vessel control device and to send one or more actuator signals to a respective one or more sail actuators and, thereby, cause the one or more sail actuators to move one or more corresponding sails.

8. A sailing vessel control system according to claim 7, further comprising one or more vessel sensors and wherein the control unit is further operable to receive and process information from the one or more vessel sensors to modify the one or more actuator signals to improve sailing effectiveness in use.

9. A sailing vessel control system according to claim 8, wherein the one or more vessel sensors include one or more sensors from the following group of sensors: a wind speed sensor, a wind direction sensor, a heel sensor, a servo input, a rudder position sensor, a user input device and a GPS unit.

10. A sailing vessel control system according to claim 7, wherein each of the one or more of the sailing vessel control devices has one or more feedback actuators operable to apply a feedback force to the line that is substantially proportional to a resistance experienced by the one or more sail actuators in use.

11. A sailing vessel control system according to claim 9, wherein:
the one or more vessel sensors comprise at least a wind direction sensor and a heel sensor; and
the control unit is operable to:
identify a tack of the vessel in use based on information received from the one or more vessel sensors; and
send one or more actuator signals to at least one of the one or more sail actuators to move a jib sail based on the tack of the vessel in use.

12. A sailing vessel control system according to claim 11, wherein the one or more vessel sensors further comprise a rudder position sensor.

13. A sailing vessel control system, comprising:
a cleat;
a bias device operable to impart a resistance;
a line having:
a first end disposed through the cleat; and
a second end operatively connected to the bias device, the bias device imparting the resistance at the line;
a sensor operable to:
detect an extent to which the line is pulled through the cleat; and
output a line signal corresponding to a position of the line;
a sail actuator operable to move a sail of a sailing vessel; and
a control unit communicatively connected to the sensor and to the sail actuator and operable to:
receive and process the line signal; and
send an actuator signal to the sail actuator to, thereby, cause movement of the sail.

14. The sailing vessel control system according to claim 13, which further comprises:
an actuator operable to apply a feedback force to the line; and
a pulley assembly through which an intermediate portion of the line is threaded, the pulley assembly operable to provide a mechanical advantage to a user pulling on the first end of the line in use.

* * * * *